US009326659B2

(12) United States Patent
Nalley et al.

(10) Patent No.: US 9,326,659 B2
(45) Date of Patent: May 3, 2016

(54) LOW-CAPACITY APPARATUS FOR WASHING OBJECTS

(75) Inventors: Michael E. Nalley, Coxs Creek, KY (US); Ronald Scott Tarr, Louisville, KY (US); Robert Scott Pickens, Wilmette, IL (US); Jessica Elizabeth Agoston, Novi, MI (US)

(73) Assignee: General Electric Company, Schenectady, NY (US)

( * ) Notice: Subject to any disclaimer, the term of this patent is extended or adjusted under 35 U.S.C. 154(b) by 867 days.

(21) Appl. No.: 13/190,202

(22) Filed: Jul. 25, 2011

(65) Prior Publication Data

US 2013/0025640 A1 Jan. 31, 2013

(51) Int. Cl.
*A47L 15/42* (2006.01)

(52) U.S. Cl.
CPC ..... *A47L 15/4251* (2013.01)

(58) Field of Classification Search
CPC ..... A47L 15/14; A47L 15/50; A47L 15/42; A47L 15/4251
USPC ..... 134/198, 200, 228
See application file for complete search history.

(56) References Cited

U.S. PATENT DOCUMENTS 6,260,565 B1 * 7/2001 Welch et al. ..... 134/200
6,460,555 B1 * 10/2002 Tuller et al. ..... 134/200
2006/0284525 A1 * 12/2006 Gorini ..... A47L 15/4229 312/228
2008/0289664 A1 * 11/2008 Rockwell et al. ..... 134/42
2012/0043871 A1 * 2/2012 Jerg ..... A47L 15/0084 312/228

FOREIGN PATENT DOCUMENTS

BE 2379160 A * 3/2003 ..... A47L 15/0084
DE 102004031591 A1 2/2006
DE WO 2010130547 A1 * 11/2010 ..... A47L 15/0084
GB 2255709 A * 11/1992 ..... A47L 15/4225
IT 2324751 A1 * 5/2011 ..... A47L 15/4212

* cited by examiner

*Primary Examiner* — Joseph L Perrin
*Assistant Examiner* — Irina Graf
(74) *Attorney, Agent, or Firm* — Dority & Manning, P.A.

(57) ABSTRACT

An appliance such as a dishwasher comprises an upper region and a lower region forming an appliance footprint. Positioned in the upper region is a spray arm assembly and a wash tub forming a wash zone. The wash zone has a low or reduced capacity, thereby holding fewer objects than conventional dishwashers but maintaining the appliance footprint so that the dishwasher fits an appliance opening, e.g., in kitchen cabinetry, that has a standard width dimension and a standard height dimension. In one embodiment, the wash zone has an opening through is received a rack, which supports the objects in the wash zone. The rack is moveable between a first position and a second position, and in one example, the rack is configured to move between the first position and the second position relative to the wash zone and independent of the spray arm assembly.

16 Claims, 4 Drawing Sheets

LOW-CAPACITY APPARATUS FOR WASHING OBJECTS

BACKGROUND OF THE INVENTION

1. Field of the Invention

The subject matter disclosed herein relates generally to appliances and, more particularly, to an appliance that fits within a standard opening in cabinetry but that has a reduced capacity for efficient consumption of energy and other resources.

2. Description of Related Art

Appliances such as conventional dishwashers are known to include upper and lower racks mounted in a washing chamber. Each rack is typically supported on side walls of the dishwasher, with movement facilitated by rollers for sliding movement between an extended position wherein the rack is substantially outside of the washing chamber and a retracted position wherein the rack is substantially inside the washing chamber. The racks often have lattice structures adapted for holding objects such as dishes, plates, cups, pots, pans and other dishware, cookware, and food storage containers. The lattice structure also permits a washing fluid (e.g., water) to impinge on the objects for cleaning items in the rack.

These appliances accommodate a particular number of objects, often referred to as the capacity. While the capacity can vary across manufacturers and models, the maximum or optimal capacity (i.e., the largest number of objects) can be quantified as about 10 to 12 place settings of dishes and/or dishware. In certain applications such as households with 1 or 2 individuals, however, it is common that this capacity is rarely if ever met, thereby resulting in frequent operation of the appliance at less than the maximum and/or preferred capacity.

Alternatives to address low and reduced capacity applications include dish-drawer and narrow-type dishwashers. Dish-drawer dishwashers include one or more pull-out drawers having, for example, an upper pull-out drawer forming a first wash tub for washing dishware and a lower pull-out drawer forming a second wash tub that can be used to supplement the first wash tub. Known drawer-type wash tubs are mounted to extensible rails that are carried by or mounted to an enclosed cabinet. Like its conventional counterpart, the cabinet is positioned under a kitchen countertop adjacent cabinetry or other kitchen appliances such as within an opening that is about 600 mm (24 inches) wide as defined by industry standards.

Narrow-type dishwashers have a reduced width dimension, resulting in a dishwasher that is narrower than both the conventional dual-rack dishwasher and the drawer-type dishwasher. That is, whereas dual-rack dishwashers fit a prescribed opening with a width of about 600 mm (24 inches), narrow-type dishwashers have a width of only about 455 mm (18 inches). Components of this type of dishwasher such as the wash tub and the racks are reduced in size, effectively providing the look and feel of the dual-rack dishwasher but with the reduced capacity owing to the reduction in at least the width dimension of the appliance.

Nevertheless, while dishwashers of both the drawer-type and the narrow-type are configured with a reduced capacity, neither is necessarily a suitable alternative. Drawer-type dishwashers are inherently complex because each drawer is configured in stand-alone fashion to retain and dispense the washing fluid onto the object contained therein. This additional complexity can lead to issues with reliability, functionality, and overall operational efficiency. Narrow-type dishwashers, on the other hand, do not fit the prescribed opening (e.g., the 600 mm opening) that is standard and found in most cabinetry, e.g., cabinetry for use in new and existing kitchens. Thus to implement dishwashers of reduced width, and to maintain aesthetics and continuity of the cabinetry, requires custom and/or customizable cabinetry, which because of cost may deter widespread implementation of narrow dishwashers.

There is therefore a need for an appliance with reduced capacity, that is compatible with the prescribed opening in cabinetry, and that is constructed to avoid and ultimately reduce the complexity and cost of the resulting appliance.

BRIEF DESCRIPTION OF THE INVENTION

There is described below in one embodiment a dishwasher that has a product configuration equipped for lower capacity, thereby permitting the dishwasher to be filled with fewer objects (e.g., dishes and dishware). By having a smaller capacity, the dishwasher is more often operated at or near its maximum capacity, particularly when utilized by users that do not regularly generate the number of objects required to fill a standard capacity dishwasher. Moreover, whereas some devices and appliances have been developed for lower volume applications, including the dishwasher drawers and compact dishwashers discussed above, none of these devices offer a standardized footprint in combination with cost and efficiency savings realized by utilizing the components, parts, and other constructive elements that are found in conventional dishwashers.

One feature of the product configuration proposed below, however, is that embodiments of the dishwasher are constructed to fit within the prescribed openings in, e.g., cabinetry, that are dimensioned for a standard capacity dishwasher. For purposes of the present discussion, dimensions for the appliance opening 132 are defined in accordance with standard appliance sizes in the United States. In one example, the standard width dimension 134 has a value of about 600 mm (24 inches) and the standard height dimension 136 has a value of about 875 mm (37.5 inches). It is contemplated that other standards may arise inside and outside of the United States, such as in and throughout the European Community, and thus dimensions for one or more of the standard width dimension 134 and the standard height dimension 136 can vary such as based on geographical location. Despite any differences, whether perceived, apparent, or otherwise, the concepts of the present disclosure can be applied as set forth herein In one embodiment, a dishwasher comprises a first region with a wash zone and a spray arm assembly that is configured to disperse a washing fluid into the wash zone. The dishwasher also comprises a second region below the upper region and configured with a support structure that positions the wash zone in spaced relation to a support surface. In one example, the first region and the second region form an appliance footprint that conforms to a standard width dimension and a standard height dimension, the wash zone has an opening through which is received a rack, and the rack is configured to move from a first position to a second position relative to the wash zone and independent of the spray arm assembly.

In another embodiment, a wash tub is described which is for use in a dishwasher that has an appliance footprint that conforms to a standard width dimension and a standard height dimension. The wash tub comprises a peripheral wall comprising a top wall, a bottom wall, a back wall, and opposing side walls, the combination of which forms a wash zone with an opening through which is received a rack. In one example, the height of the opening occupies less than about 75% of the standard height dimension, and the width of the opening occupies at least about 75% of the standard width dimension.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

Figure 1:
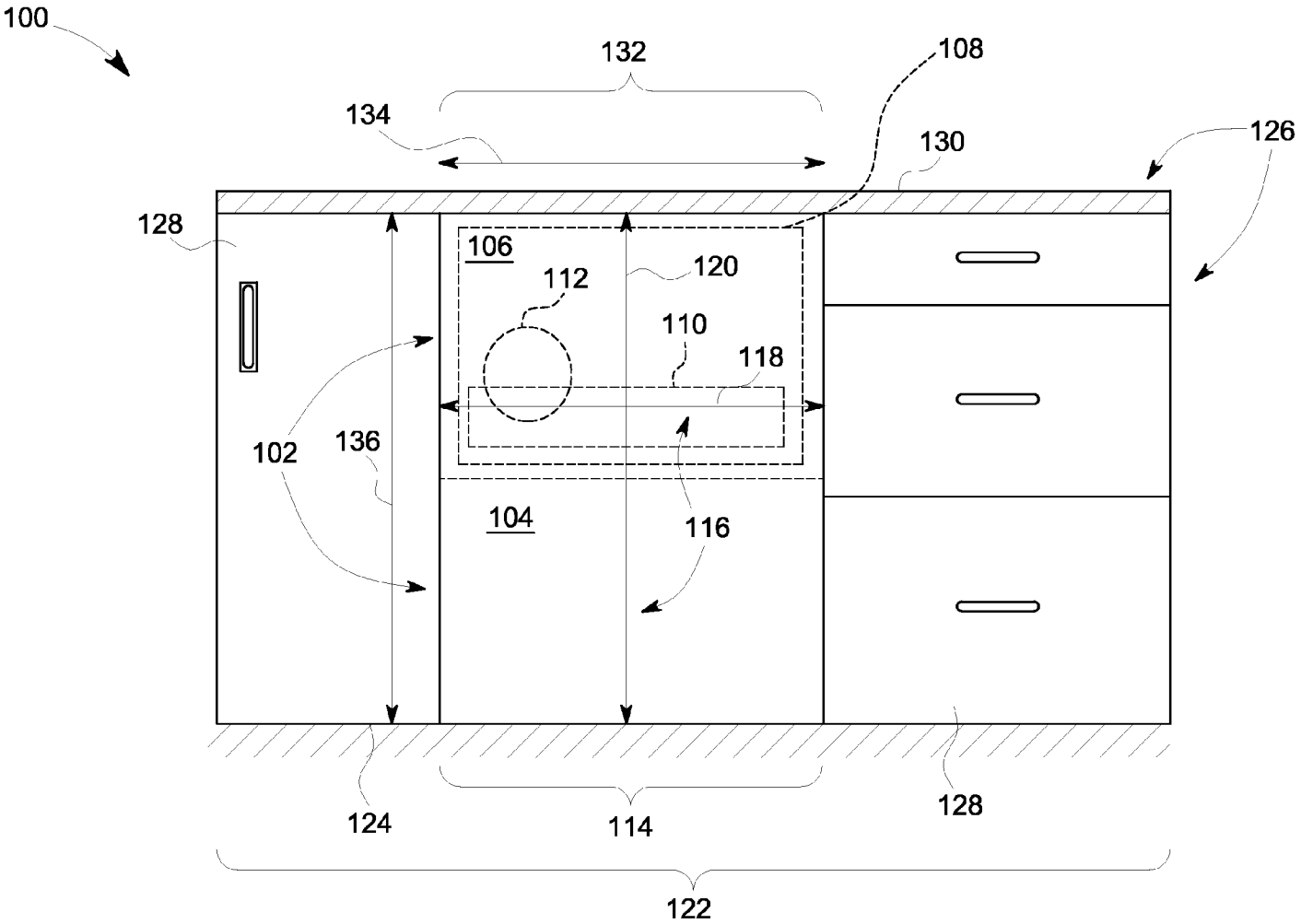
FIG. 1 is a schematic diagram of an exemplary embodiment of an appliance.

FIG. 1 is a schematic diagram of an appliance 100, which illustrates at a high level the concepts of the present disclosure. The appliance 100 includes various regions 102 that comprise a first region 104 (or "lower region 104") and a second region 106 (or "upper region 106") with a wash zone 108 that is configured to receive a rack 110 in which objects 112 can be positioned to be washed. The first region 104 and the second region 106 form an appliance footprint 114, which is defined by dimensions 116 such as a width dimension 118 and a height dimension 120.

The appliance 100 is shown in an installed configuration 122 such as would be found in a home, office, and other residential and commercial setting. Sitting on a support surface 124, such as a floor in a kitchen, the installed configuration 122 includes installed components 126 including cabinetry 128 and a countertop 130. The installed components 126 form an appliance opening 132, which is typically defined by a standard width dimension 134 and a standard height dimension 136.

In one embodiment, the appliance footprint 114 is configured to fit the appliance opening 132 without the need for additional and/or customized pieces of the installed components 126. Components of the appliance 100 are selected and sized so that the dimensions 116 of the appliance footprint 114 are the same, or substantially the same, as the dimensions for the appliance opening 132. In one example, the width dimension 118 and the height dimension 120 are the same as, respectively, the standard width dimension 134 and the standard height dimension 136 discussed above. Of course, in other exemplary constructions of the appliance 100, it is contemplated that dimensional tolerances and related deviations from the appliance opening 132 can cause each of these dimensions to vary, thereby preventing any one-to-one correspondence between the appliance footprint 114 and the appliance opening 132. It follows that embodiments of the appliance 100 are contemplated in which this variability is incorporated, but that still embody concepts that fall within the scope and spirit of the present disclosure.

The wash zone 108 has an opening (not shown) through which is received the rack 110. To provide for and to reduce the capacity of the appliance 100, in one embodiment, the opening has a height and a width that are configured to occupy only a portion of the appliance footprint 114. By way of example, but not limitation, this portion is defined as a percentage of one or more of the standard width dimension 134 and the standard height dimension 136. Construction of the appliance 100 is selected so this percentage is consistent with the capacity desired for the wash zone 108, e.g., the size of the rack 110 and/or the number of objects 112 that can fit and be effectively washed in the wash zone 108. In one example, the height of the opening does not exceed about 60% of the standard height dimension 136. However, in other examples the height can vary so as not to exceed from about 50% to about 75% of the standard height dimension.

Unlike other low and reduced capacity appliances, however, embodiments of the appliance 100 maintain many of the structural features found on appliances such as conventional dishwashers. For example, the size of the wash zone is configured so as that the wash zone can receive racks (e.g., the rack 110) that fit into standard or conventional dishwashers. Thus whereas the height of the opening is smaller, the width in one example is the same or similar to conventional dishwashers. Moreover, cleaning of the objects 112 is facilitated by way of working components such as pumps, valves, and tubing and conduits that are used in conventional dishwashers. These working components are disposed in a manner that is compatible with the configuration of the wash zone 108 and the appliance footprint 114. In one example, the rack 210 is configured to move independent of these working components as well as independent and relative to the wash zone 108. These features are beneficial to reduce the cost and complexity of the appliance 100, which conforms more readily to the pricing, reliability, and operability of consumer goods and consumer markets.

Figure 2:
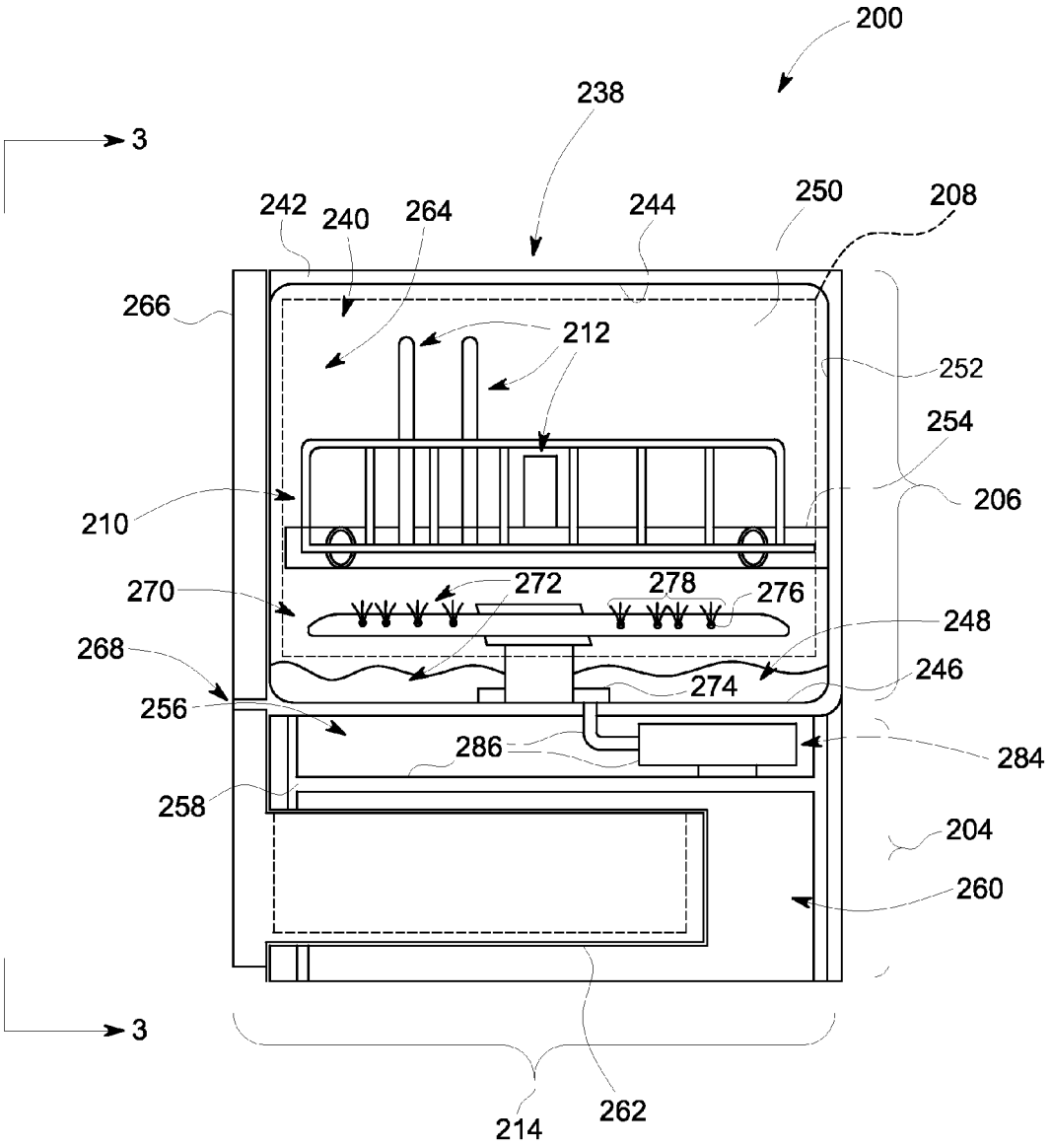
FIG. 2 is a side, cross-section of another exemplary embodiment of an appliance.

Some of these working components are discussed in connection with FIGS. 2-4, in which another exemplary embodiment of an appliance 200 is illustrated. Like numerals are used to identify like components as between FIG. 1 and FIGS. 2-4, except the numerals are increased by 100 in FIGS. 2-4. FIG. 2 is a cross-sectional, side view of the appliance 200, with the front of the appliance 200 depicted on the left of the figure.

The appliance 200 includes a first region 204 (or "lower region 204"), a second region 206 (or "upper region 206") with a wash zone 208, and a rack 210 in which objects 212 are positioned. The combination of the first region 204 and the second region 206 form an appliance footprint 214. The second region 206 includes an upper structure 238 that comprises a wash tub 240, which forms in one example the wash zone 208. The wash tub 240 comprises a peripheral wall 242 with a top wall 244, a bottom wall 246 that forms a basin 248, opposing side walls 250, and a back wall 252. The opposing side walls 250 are configured to receive the rack 210, which positions and supports the objects 212 such as dishes and dishware commonly cleansed using the appliance 200. The rack 210 is moveable with respect to the wash zone 208 by way of, for example, one or more rails 254 that are secured to the opposing side walls 250. In one embodiment, features such as grooves, slots, and detents can be used in lieu the rails 254, wherein such features can be integrated into, e.g., one or more of the opposing side walls 250.

Located in the first region 204 is a lower structure 256 that is equipped with a support structure 258 on which is situated one or more parts of the upper structure 238. The support structure 258 can form a storage area 260. In one example, a drawer 262 is positioned in the storage area 260 and is configured to slide relative to the wash zone 208 into and out of the support structure 258.

Figure 3:
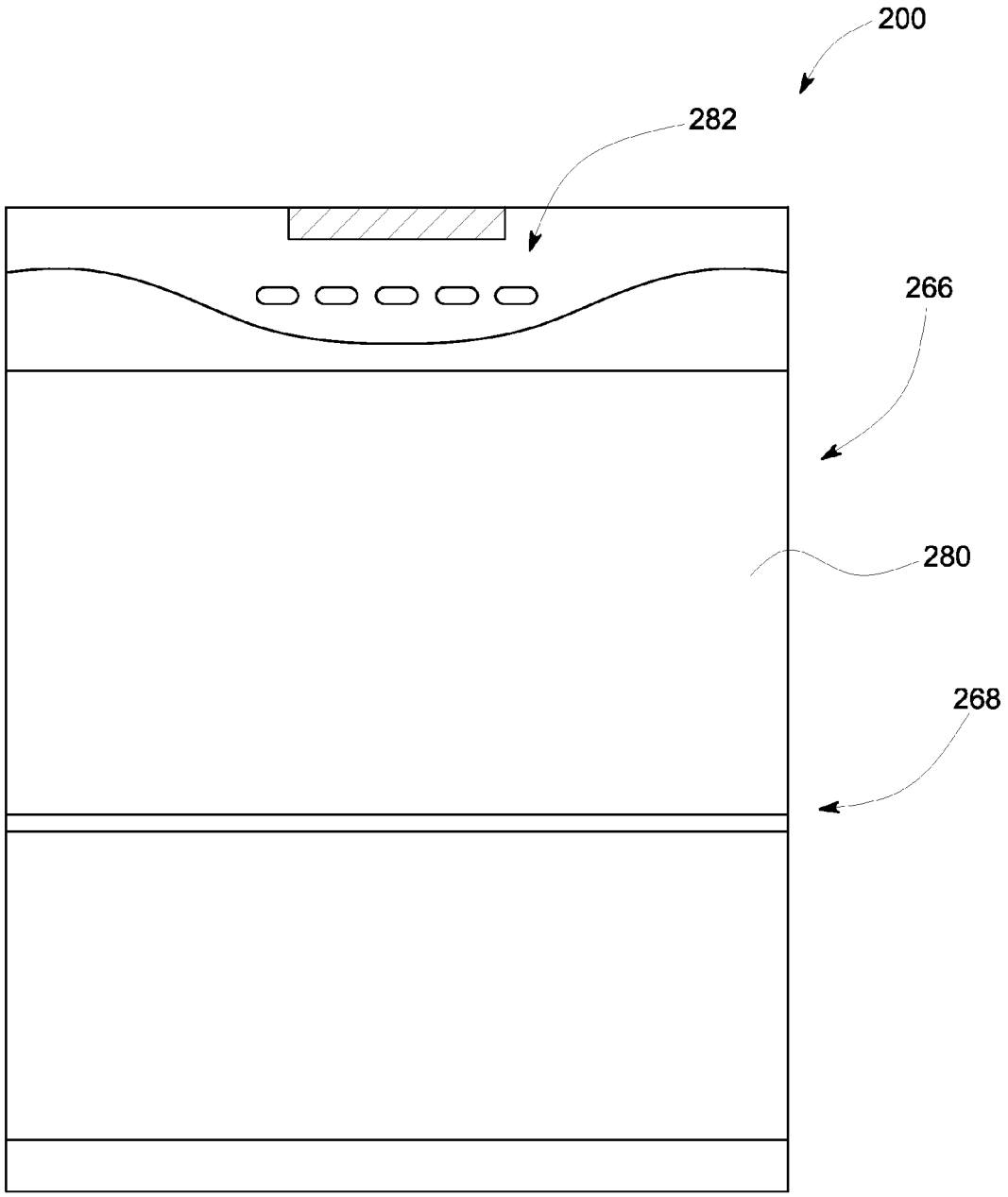
FIG. 3 is a front view of the appliance of FIG. 2.
Figure 4:
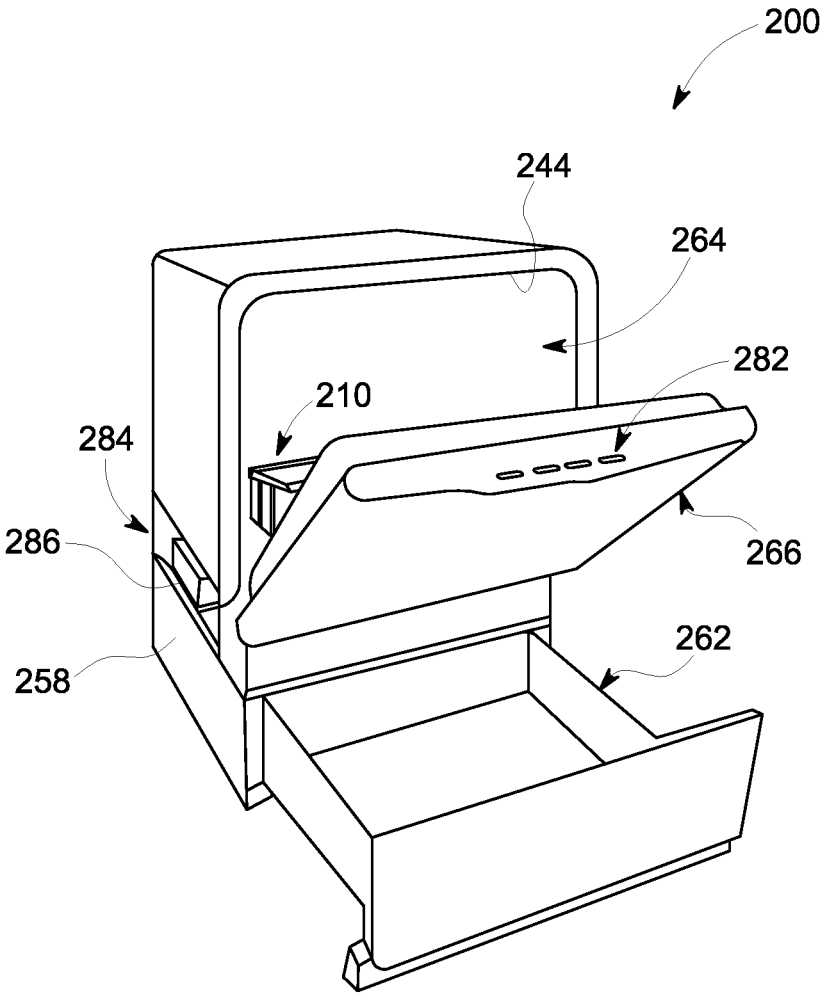
FIG. 4 is a perspective view of the appliance of FIGS. 2 and 3.

The wash zone 208 has an opening 264 that is covered by a door 266 with a hinged bottom portion 268 such as for movement between a normally closed vertical position (shown in FIGS. 2 and 3) wherein the wash zone 208 is sealed shut (e.g., with a water-tight seal) for washing operation, a partially open position (an example of which is shown in FIG. 4), and a fully open position (not shown) in which the door 266 is effectively horizontal and supportive of the rack 210 for loading and unloading of the objects 212 stored therein.

In one construction, the appliance 200 includes a spray arm assembly 270, which is located in the wash zone 208 and through which is dispersed a washing fluid 272. A heating element 274 is disposed proximate the basin 248 such as circumferentially about the spray arm assembly 270. The heating element 274 is in thermal communication with a washing fluid 272 in the basin 248 so as to convey heat to the washing fluid 272 during operation of the appliance 200. The spray arm assembly 270 includes discharge ports 276 such as one or more spray jets 278, which are orifices for directing the washing fluid 272 onto the objects 212 located in the rack 210.

The angle of the spray jets 278 can vary, depending for example on the size of the wash zone 208. Likewise the arrangement of the spray jets 278 in the spray arm assembly 270 can result in a rotational force as the washing fluid 272 flows through the spray jets 278. The resultant rotation of spray arm assembly 270 provides coverage of dishes and other dishwasher contents with the washing fluid. In one embodiment, the spray arm assembly 270 is configured to rotate, generating in one example a swirling spray pattern below the rack 210.

The rack 210 and the rails 254 are provided so that the rack 210 is moveable such as by slideable or rolling engagement with the rails 254. In one embodiment, the rack 210 can have wheels that roll on a shelf (not shown) coupled or incorporated into the peripheral wall 242 (e.g., the opposing side walls 250) and/or the door 266. The rack 210 can have a mesh-like formation suitable for holding and securing upright the objects 212 to permit contact with the washing fluid 272. Other configurations of the rack 210 are likewise contemplated and will be recognized by those artisans skilled in and familiar with the relevant appliance art.

In one embodiment, the rack 210 is substantially porous so that fluid (e.g., the washing fluid 272) ejected from the spray arm assembly 270 passes through the rack 210 and impinges on the objects. The rack 210 is fabricated from known materials into lattice structures including a plurality of elongated members, and each is adapted for movement between an extended loading or first position, in which at least a portion of the rack 210 is positioned outside the wash zone 208, and a retracted or second position (shown in FIG. 2) in which the rack is located inside the wash zone 208. In one embodiment, the rack 210 moves independent of an relative to one or more of the wash zone 208 (and the wash tub 240) and the spray arm assembly 270. Alternative constructions are also contemplated to include a silverware basket (not shown) that is removably attached to rack 210 for placement of silverware, utensils, and the like that are too small to be accommodated by the rack 210 contemplated herein.

As best shown in FIGS. 3 and 4, mounted at a convenient location on an outer face 280 of the door 266 and coupled to known control circuitry is a control input selector 282 such as a keypad, toggle array, and/or other combination of actuatable items (e.g., buttons). The control input selector 282 is also coupled to other control mechanisms (not shown) for circulating fluids such as water and other fluids (e.g., detergent) in the wash zone 208. In one embodiment, the appliance 200 includes a machinery compartment 284 (FIG. 4), which accommodates one or more washing components 286 that include, but are not limited to, pumps, conduits (e.g., tubing), valves, and similar components that facilitate and effectuate operation of the appliance 200.

In one example, the wash tub 240 has a single rack configuration, in which the wash tub 240 is configured to fit only a single rack (e.g., the rack 210) and/or a defined number of objects (e.g., the objects 212). Other examples of low-capacity dishwashers hold only about 5 to about 8 place settings of dishes and dishware. The opposing side walls 250 are dimensioned and the rack 210 is positioned in the wash zone 208, for example, to provide clearance as between the top wall 244 and the peripheral edges of the objects 212 in the rack 210. The clearance allows the objects 212 to be loaded onto the rack 210, the rack 210 to be positioned inside of the wash zone 208, and the door 266 to be closed and secured for execution by the appliance 100 of one or more wash cycles.

The support structure 258 is configured to support the various components of the appliance 200, including the wash tub 240 and the washing components 286. Support for the washing components 286 can be provided by structural segments (not shown) that are useful to position and secure the washing components 286 so not to interfere with operation of the drawer 262. Noted is that implementation of the concepts discussed herein does not encumber the rack 210 with unnecessary components such as the basin, the pump, and the spray arms secured to dishwasher drawers and related variations. Rather the wash tub 240, the washing components 286, and the spray arm assembly 270 are affixed in one or both of the second region 206 and the first region 204 so as not to be affected by or interfere with manipulation of the rack 210 into and out of the wash zone 208. In one embodiment, the rack is configured to move from a first position to a second position relative to the wash zone and independent of the spray arm assembly 270.

Components in the first region 204 and the second region 206 such as the wash tub 240 and the support structure 258 can be provided separately as individualized components. This is customary subsequent to assembly or manufacturing processes that are used to construct together the various components of the appliance 200. These components may be stacked or otherwise positioned so that the first region 204 (including, in one example, the support structure 258) is in subjacent and supportive relation to the second region 206, in which is included the wash tub 240 and related components. The drawer 262 may be omitted in such construction in lieu of a pedestal, step, or other configuration of the support structure 258 that can support the components of the second region 206. In still other embodiments, the first region 204 can comprise cabinetry that is sized and configured to position the second region 206 at a location that is comfortable for the end user to fill the rack 210 and otherwise to operate the appliance 200.

Where applicable it is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A dishwasher, comprising:

an upper region comprising a wash zone and a spray arm assembly that is configured to disperse a washing fluid into the wash zone; and a lower region adjacent and below the upper region, the lower region comprising a support structure, a machinery compartment, and a drawer including a solid bottom wall and solid opposing side walls, the solid bottom wall and the solid opposing side walls defining a dry storage area, wherein (i) the machinery compartment and the dry storage area are separated from one another by a portion of the support structure, (ii) the machinery compartment is located below the upper region and above the dry storage area and the dry storage area is located below the machinery compartment and above a support surface, (iii) the support structure supports washing components including at least one of a pump, a conduit, and a valve in the machinery compartment and (iv) the support structure positions the wash zone in spaced relation to the support surface, wherein the upper region and the lower region form an appliance footprint that is dimensioned with a height, a width, and a depth of the appliance footprint to fit snugly within a cabinet opening, wherein the wash zone has an opening defining a height and a width of the opening through which is received a rack, and wherein the rack is configured to move from a first position to a second position relative to the wash zone independent of the spray arm assembly, and wherein the solid bottom wall is dimensioned with a width substantially identical to the width of the appliance footprint.

2. The dishwasher according to claim 1, wherein the height of the opening does not exceed about 60% of the height of the appliance footprint.

3. The dishwasher according to claim 2, wherein the height of the cabinet opening is about 875 mm.

4. The dishwasher according to claim 1, wherein the width of the cabinet opening is about 600 mm.

5. The dishwasher according to claim 4, wherein the width of the opening is at least about 80% of the width of the cabinet opening.

6. The dishwasher according to claim 1, wherein the drawer is moveable with respect to the wash zone, independent of the spray arm assembly.

7. The dishwasher according to claim 1, further comprising a wash tub forming the wash zone therein, wherein the wash tub is configured to support the rack in the wash zone.

8. The dishwasher according to claim 7, further comprising a rail coupled to the wash tub and configured to receive the rack thereon.

9. The dishwasher according to claim 1, further comprising a door configured to seal the wash zone for execution of washing operations.

10. The dishwasher of claim 1, wherein the washing components include at least the pump, the conduit, and the valve in the machinery compartment.

11. A dishwasher, comprising:

an upper region comprising a wash tub comprising a peripheral wall with a top wall, a bottom wall, a back wall, and opposing side walls, the combination of which forms a wash zone with an opening through which is received a rack that positions and supports objects to be washed; and a lower region adjacent and below the upper region, the lower region comprising a support structure, a machinery compartment, and a drawer including a solid bottom wall and solid opposing side walls, the solid bottom wall and the solid opposing side walls defining a dry storage area, wherein (i) the machinery compartment and the dry storage area are separated from one another by a portion of the support structure, (ii) the machinery compartment is located below the upper region and above the dry storage area and the dry storage area is located below the machinery compartment and above a support surface, (iii) the support structure supports washing components including at least one of a pump, a conduit, and a valve in the machinery compartment, and (iv) the support structure positions the wash zone in spaced relation to the support surface, wherein the upper region and the lower region form an appliance footprint that is dimensioned with a height, a width, and a depth to fit snugly within a cabinet opening, wherein a height of the opening is less than about 75% of a height of the cabinet opening, and a width of the opening is at least about 75% of a width of the cabinet opening, and wherein the solid bottom wall is dimensioned with a width substantially identical to the width of the appliance footprint.

12. The dishwasher according to claim 11, wherein the width of the cabinet opening is about 600 mm.

13. The dishwasher according to claim 11, wherein the height of the cabinet opening is about 875 mm.

14. The dishwasher according to claim 11, wherein the peripheral wall of the wash tub is configured to support the rack in the wash zone.

15. The dishwasher according to claim 14, wherein the side walls of the wash tub have integrated therein features that are configured to position the rack in the wash zone.

16. A dishwasher positionable within a cabinet opening having a width of about 600 mm and a height of about 875 mm, the dishwasher comprising:

an upper region comprising a wash tub having an attached top wall, bottom wall, back wall, and opposing side walls, the wash tub defining a wash zone opening, a spray arm assembly defining a plurality of discharge ports to disperse a washing fluid into the wash tub, and a slidable rack disposed above the spray arm, the slidable rack being selectively positionable within the wash tub and through the wash zone opening, independent from the spray arm assembly; and a lower region positioned below the upper region in alignment therewith, the lower region comprising a plurality of working components, including a pump, a conduit, and a valve, a support structure, a machinery compartment enclosing the plurality of working components, and a slidable drawer including a solid bottom wall and solid opposing side walls, the solid bottom wall and the solid opposing side walls defining a dry storage area below the machinery compartment and above the bottom wall, wherein a portion of the support structure is positioned between the machinery compartment and the slidable drawer, and wherein another portion of the support structure is positioned between the slidable drawer and a support surface;

wherein the upper region and the lower region form an appliance footprint that is dimensioned with a height, a width, and a depth to fit within the cabinet opening, wherein a height of the wash zone opening is less than about 75% of a height of the cabinet opening, and a width of the wash zone opening is at least about 75% of a width of the cabinet opening, and wherein the solid bottom wall is dimensioned with a width substantially identical to the width of the appliance footprint.

* * * * *